United States Patent [19]

Schaffner et al.

[11] 4,196,866

[45] Apr. 8, 1980

[54] UNWINDING APPARATUS FOR ROLLS OF SHEET MATERIAL

[75] Inventors: Georg Schaffner, Neuss; Karl Thievessen, Hilden; Peter Weiss, Monheim-Baumberg, all of Fed. Rep. of Germany

[73] Assignee: Jagenberg Werke Atkiengesellschaft, Dusseldorf, Fed. Rep. of Germany

[21] Appl. No.: 971,294

[22] Filed: Dec. 20, 1978

[30] Foreign Application Priority Data

Jan. 2, 1978 [DE] Fed. Rep. of Germany ..... 2800098

[51] Int. Cl.[2] ..... B65H 75/34; B65H 17/02

[52] U.S. Cl. ..... 242/64; 242/58.1; 242/67.1 R

[58] Field of Search ..... 242/64, 67.1 R, 58, 242/58.1, 67.3 R, 58.2

[56] References Cited

U.S. PATENT DOCUMENTS

| | | | |
|---|---|---|---|
| 1,449,093 | 3/1923 | Finley | 242/64 |
| 3,391,876 | 7/1968 | Dalglish | 242/67.1 R X |
| 3,948,715 | 4/1976 | Tokuno | 242/58.1 |
| 4,065,067 | 12/1977 | Martinez | 242/58.1 |

FOREIGN PATENT DOCUMENTS

| | | | |
|---|---|---|---|
| 2312635 | 9/1974 | Fed. Rep. of Germany | 242/64 |

*Primary Examiner*—Edward J. McCarthy

*Attorney, Agent, or Firm*—Sprung, Felfe, Horn, Lynch & Kramer

[57] ABSTRACT

An apparatus for unwinding rolls of sheet material and for adhering the end of one roll to the beginning of the next at full running speed, without interruption. Means are also provided to permit operation with rolls of different widths and even with two narrow rolls alongside one another. A support which can be operatively positioned between two such narrow rolls can be moved laterally out of the way to take up an end-supporting position when a single wide roll is being unwound.

3 Claims, 3 Drawing Figures

UNWINDING APPARATUS FOR ROLLS OF SHEET MATERIAL

Figure 1:
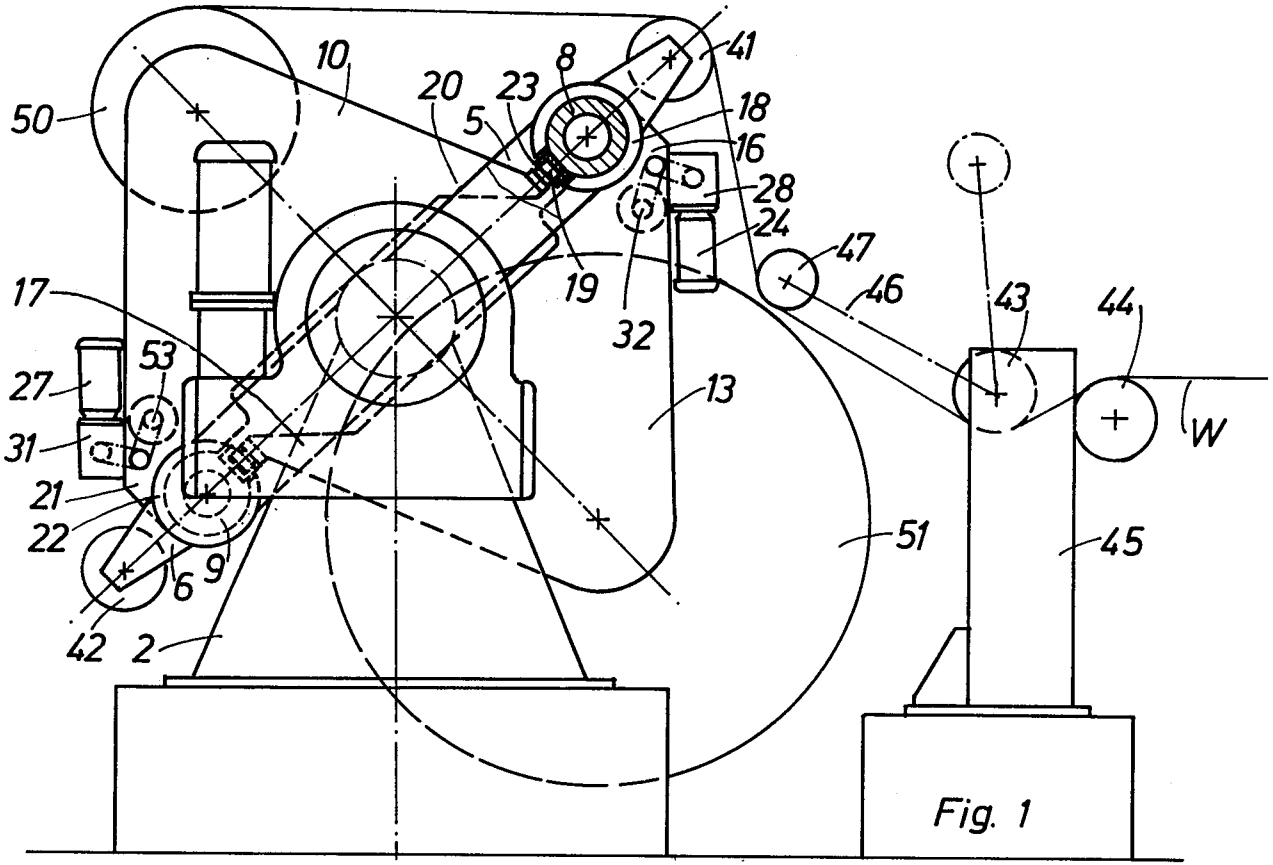

The invention relates to an unwinding apparatus for sheet material in the form of rolls, consisting of a double-armed turnstile the ends of whose arms are interconnected through traverses, and of two pairs of supporting arms disposed on opposite sides of the frame formed by the arms of the turnstile and the traverse, and having chucks, in particular chucks provided with brakes, for receiving the ends of the rolls to be unwound, each of said pairs of supporting arms being held by a pair of outriggers to the traverse and being axially slidable thereon for adjustment to a desired roll width, one of the outriggers associated with a given traverse being guided on the traverse parallel to each pair of outriggers, and the outrigger associated with the other traverse being supported thereon, in such a way that the outriggers of the supporting arms disposed on opposite sides of the frame may be moved past each other without interference.

The special advantage of an unwinding apparatus of this type which has a double-armed turnstile (published unexamined German Patent Application 2,312,635) over two individual unwinding apparatuses arranged in tandem and having swinging arms operable independently of each other is that the tail end of the web from the first roll can be fastened to the head end of the second roll at full unwinding speed. While webs of different widths can be unwound with the individual unwinding apparatuses, only one roll can be unwound on each frame side. Other prior art individual unwinding apparatuses which are arranged in tandem and have swinging arms rotatable independently of each other do not have this drawback. In these unwinding apparatuses a further swinging arm is disposed between the two outer swinging arms. When a web of great width is to be processed, the third swinging arm is raised. In its raised position this arm does not interfere, as in this apparatus a roll change at full operating speed is not contemplated in unwinding. In the unwinding apparatus of the type described initially, however, such an arm capable of being raised would interfere in its raised position with the guiding of the web during the change from one roll to another.

The object of the invention is to provide an unwinding apparatus of the type described initially which permits not only changing from the unwinding roll to a full roll at full operating speed and unwinding webs of different widths but also the simultaneous unwinding of webs of different widths and the use of rolls of different diameters.

In accordance with the invention, this object is accomplished by providing between the pair of supporting arms a further pair of supporting arms which, like the two adjacent supporting arms, is guided on one of the traverses parallel to a pair of outriggers and supported on the other traverse, and whose chuck is adapted to be coupled, secured against twisting, to the chuck of the adjacent supporting arms through a connecting member.

The invention is based on the idea that in the unwinding of wide webs the two outer supporting arms need not necessarily carry the roll directly; the middle supporting arm is also capable of doing so if it can be moved into the normal position of one of the outer supporting arms to take over its functions. In this way, it is at the same time moved out of the way.

The coupling connecting member preferably is a clamping sleeve. This type of connection, secured against twisting, is extermely simple as it corresponds to that of the mounted roll.

In accordance with a further refinement of the invention, the adjacent supporting arm, whose chuck can be coupled, secured against twisting, to that of the middle supporting arm, is adapted to be moved sideways beyond the position required for the maximum of the web by the minimum width occupied by the middle supporting arm which is coupled to it. This provides assurance that the full width of the unwinding apparatus available without the middle supporting arm is utilized.

Figure 2:
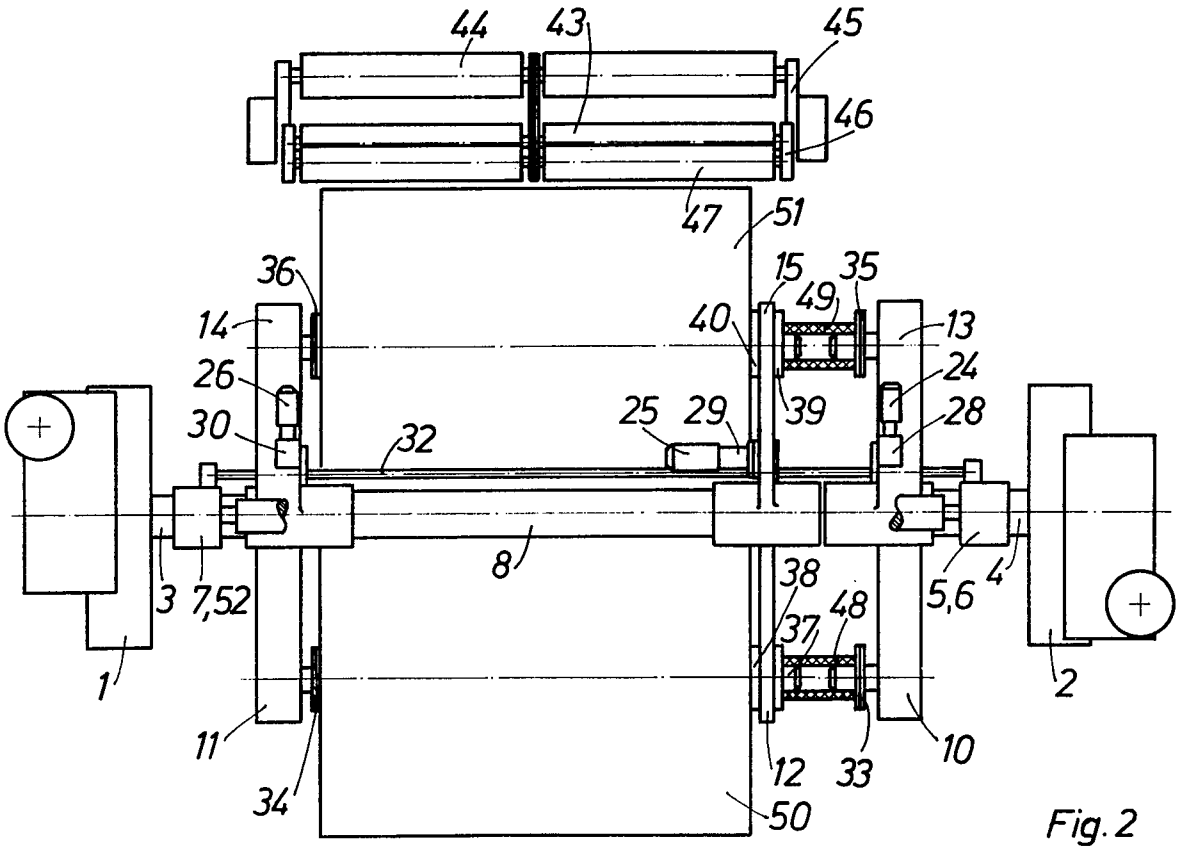
Figure 3:
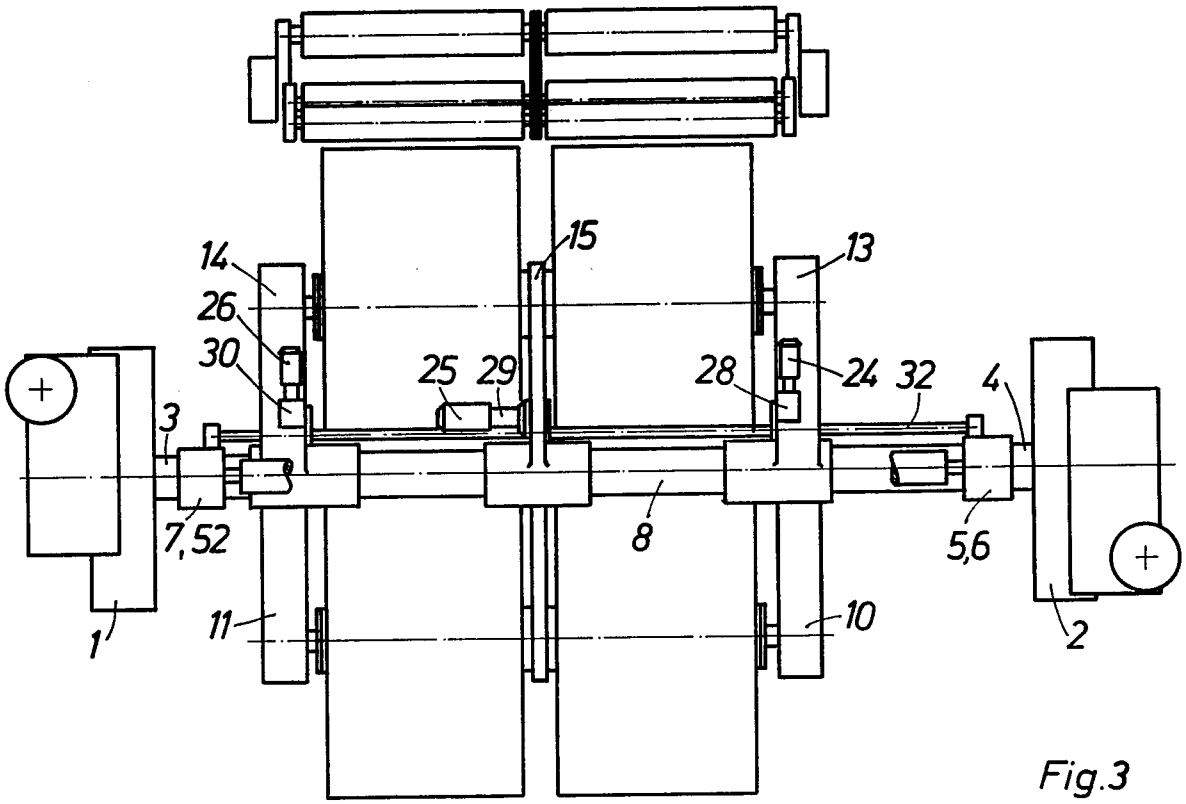

The invention is explained below in detail with reference to the drawings illustrating an exemplified embodiment, where FIG. 1 is a side elevation of an unwinding apparatus;

FIG. 2 is a plan view of the unwinding apparatus according to FIG. 1 with a roll on either side of the frame; and FIG. 3 is a plan view of the unwinding apparatus according to FIG. 1 with two rolls on either side of the frame.

Mounted on the arms 5,6,7 and 52 in two side stands 1 and 2 by means of a shaft 3 and 4 is a turnstile the ends of whose arms are interconnected through traverses 8 and 9. The fours arms 5, 6, 7 and 52 of the turnstile and the two traverses 8 and 9 form a frame.

On each side of the frame 5 to 9 and 52, two outer and one inner supporting arms 10, 11, 12, 13, 14 and 15 are disposed so as to be axially slidable. Each supporting arm has a pair of outriggers 16 and 17. The outrigger 16 has a longitudinally slit pipe section 18 whereby it provides the desired parallel guidance for the supporting arm 13 on the traverse 8, constructed as a tube. The other outrigger 17 engages by a projection 19, in particular one provided with a roller, a guide groove of the other traverse 9, for example, a U-rail fixed to the traverse 9, whereby the supporting arm 13 is braced. The two other supporting arms 14 and 15 disposed on the same side of the frame are correspondingly guided or braced, on the traverse 8 and 9. The supporting arms 10, 11 and 12 disposed on the opposite side of the frame likewise have outriggers 21 and 20 with pipe sections 22 as parallel guides and projections 23 for support. However, the arrangement of the pipe sections 22 and projections 23 disposed on the supporting arms 10, 11 and 12 is the reverse of that of the pipe sections 18 and projections 19 of the supporting arms 13, 14 and 15 disposed on the opposite side. This makes it possible to move the opposed supporting arms 10 to 12 and 13 to 15 past each other without interference.

For the purpose of the axial positioning and fixing of the supporting arms 13 to 15, there is asociated with each supporting arm a servomotor 24, 25 and 26 which is coupled through a gear train 28, 29 and 30 to a spindle 32 carried by the turnstile arms 5 to 7. This is the case also with the supporting arms 10 to 12, which are coupled through servomotors 27 and gear trains 31 to a spindle 53 carried by the turnstile arms 6 and 52.

Each of the supporting arms 10, 11, 13 and 14 has at its free end a chuck 33, 34, 35 and 36 which is provided with a brake, not shown, and which can be accelerated through a motor, likewise not shown, to the desired rotative speed. The two supporting arms 12 and 15 between the outer supporting arms 10, 11, 13 and 14 carry on opposite sides chucks 37, 38, 39 and 40 which are supported freely rotatable in the supporting arms 12 and 15, the chucks 37 and 38, and 39 and 40, being connected in pairs, secured against twisting, for example, through a plug connection or an electromagnetic clutch, but may also be released from each other. In the operational case according to FIG. 3 they are released in order that rolls of different diameters may be unwound simultaneously.

For the guidance of the web, the ends of the turnstile arms 5, 6, 7 and 52 have guide rollers 41 and 42. Further guide rollers 43 and 44 for the guidance of the unwinding fabric web are rotatably mounted in an adjacent stand 45. The stand 45 further carries on a swinging arm 46 a roller 47 with which the material of a roll nearly completely unwound may be pressed against a new roll.

In FIG. 2, the supporting arms 12 and 15 have been moved in the direction of the outer supporting arms 10 and 13. The chucks 33 and 35 are connected, secured against twisting, to the chucks 37 and 39 of the supporting arms 12 and 15 through clamping sleeves 48 and 49. Moreoever, in this operational case the pairs of chucks 37 and 38, and 39 and 40, respectively, are coupled to each other, secured against twisting. The brakes and the drive motors of the chucks 33 and 35 thus are able to act upon the chucks 38 and 40 so that the unwinding rolls 50 and 51 which are chucked between the chucks 34 and 38, and 36 and 40, respectively, may be braked or accelerated on both sides. In unwinding, the fabric roll 50 at first is in the position of the roller 41 according to FIG. 1, During unwinding, the supporting arms for the unwinding roll 51 may be removed and a new, full roll may be chucked. As soon as the end of the web on the unwinding roll is approached, the frame with the supporting arms is swung counter-clockwise so that the fabric roll 50 is in the position shown in FIG. 1. The web W then runs over the guide roller 41. The full roll then occupies the position of the roll 51. The head end of this full roll 51 is provided with a strip of adhesive tape. As soon as the end of roll 50 is reached, the split pressure roller 47 is swung around counter-clockwise and the web W is pressed against the strip of adhesive tape on the surface of the roll 51, meanwhile brought to synchronous speed by the motor. Thus the tail end of one web is fastened to the head end of the next web so that the web may unwind without interruption of operation.

In order to be able to process on the same side of the frame two rolls of the same width or of different widths, the middle supporting arm is moved toward the center so that during chucking the supporting arms are in the position shown in FIG. 3.

It will be appreciated that the instant specification is set forth by way of illustration and not limitation, and that various modifications and changes may be made without departing from the spirit and scope of the present invention.

What is claimed is:

1. In an unwinding apparatus for rolls of sheet material comprising a double-armed turnstile having arms interconnected through traverses to form a frame, two pairs of supporting arms disposed on opposite sides of the frame, chucks provided with brakes for receiving the ends of the rolls to be unwound, and two pairs of outriggers each holding a respective pair of supporting arms to the traverse and being axially slidable thereon for adjustment to a desired roll width, one of the outriggers associated with a given traverse being guided on the traverse parallel to each pair of outriggers, and the outrigger associated with the other traverse being supported thereon in such a manner that the outriggers of the supporting arms disposed on opposite sides of the frame may be moved past each other without interference, the improvement which comprises two further pairs of middle supporting arms respectively disposed between each pair of supporting arms and guided on a respective traverse parallel to a pair of outriggers and supported on the other traverse, and a further chuck for coupling each further pair of supporting arms without possible twisting to the chuck of the adjacent supporting arms.

2. An unwinding apparatus according to claim 1, wherein each further chuck is connected to each first-mentioned chuck by a clamping sleeve.

3. An unwinding apparatus according to claim 1, wherein the adjacent supporting arm whose chuck may be coupled to that of a middle supporting arm is mounted so as to be movable sideways beyond the position required for the maximum web width by at least the width of the middle supporting arm coupled to it.

* * * * *